US008656836B2

(12) United States Patent
Koo et al.

(10) Patent No.: US 8,656,836 B2
(45) Date of Patent: Feb. 25, 2014

(54) OFFSET PRINTER

(75) Inventors: Jae Bon Koo, Daejeon (KR); In-Kyu You, Daejeon (KR); Minseok Kim, Cheongju-si (KR); Taeyoub Kim, Seoul (KR)

(73) Assignee: Intellectual Discovery Co., Ltd., Seoul (KR)

( * ) Notice: Subject to any disclaimer, the term of this patent is extended or adjusted under 35 U.S.C. 154(b) by 50 days.

(21) Appl. No.: 13/294,201

(22) Filed: Nov. 11, 2011

(65) Prior Publication Data

US 2012/0125214 A1 May 24, 2012

(30) Foreign Application Priority Data

Nov. 22, 2010 (KR) ..... 10-2010-0116325

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS

| | | | | |
|---|---|---|---|---|
| 5,184,149 | A * | 2/1993 | Tanaka et al. | 346/74.2 |
| 5,367,953 | A * | 11/1994 | Yamashita et al. | 101/158 |
| 5,533,447 | A * | 7/1996 | Johnson et al. | 101/211 |
| 6,315,468 | B2 * | 11/2001 | Kishida et al. | 400/55 |
| 7,658,147 | B2 * | 2/2010 | Chung et al. | 101/483 |
| 2004/0123753 | A1 * | 7/2004 | Yoo et al. | 101/158 |
| 2007/0157830 | A1 * | 7/2007 | Kim et al. | 101/41 |
| 2010/0220160 | A1 * | 9/2010 | Shimizu et al. | 347/85 |

FOREIGN PATENT DOCUMENTS

| | | | |
|---|---|---|---|
| JP | 58-72457 | A | 4/1983 |
| JP | 5-162477 | A | 6/1993 |
| JP | 2000-158633 | A | 6/2000 |
| JP | 2006-106127 | A | 4/2006 |
| JP | 2006-222157 | A | 8/2006 |
| JP | 2006-236914 | A | 9/2006 |
| JP | 2007-76040 | A | 3/2007 |
| JP | 2008-80699 | A | 4/2008 |
| JP | 2008-207526 | A | 9/2008 |
| JP | 2009-172835 | A | 8/2009 |
| JP | 2010-143103 | A | 7/2010 |
| KR | 10-2010-0002405 | A | 1/2010 |
| KR | 10-2010-0064576 | A | 6/2010 |
| KR | 10-2010-0071440 | A | 6/2010 |

* cited by examiner

*Primary Examiner* — Anthony Nguyen
(74) *Attorney, Agent, or Firm* — Rabin & Berdo, P.C.

(57) ABSTRACT

Provided is an offset printer configured to increase or maximize productivity and yield. The offset printer includes a printing roller, a coating unit configured to apply a printing substance to the printing roller, a patterning unit configured to pattern the printing substance applied to the printing roller from the coating unit, a printing unit configured to transfer the patterned printing substance to a printing medium, and a cleaning unit configured to clean the printing substance remaining on the printing roller by a dry cleaning method.

9 Claims, 4 Drawing Sheets

OFFSET PRINTER

CROSS-REFERENCE TO RELATED APPLICATIONS

This U.S. non-provisional patent application claims priority under 35 U.S.C. §119 of Korean Patent Application No. 10-2010-0116325, filed on Nov. 22, 2010, the entire contents of which are hereby incorporated by reference.

BACKGROUND

The present disclosure herein relates to a printer, and more particularly, to an offset printer.

Owing to printing technology, many copies of data such texts, pictures, and photographs can be made. Printing technology has been researched to produce a large number of copies with lower costs. Recently, research has been conducted to apply printing technology to manufacturing processes of next-generation portable electric devices, and results of such research have been reported. However, no printer has been developed, which can improve the productivity of electronic device production lines.

SUMMARY

The present disclosure provides an offset printer in which a printing roller can be less contaminated.

The present disclosure also provides an offset printer configured to increase the lifespan of a printing roller.

The present disclosure also provides an offset printer configured to prevent swelling of ink applied to a printing roller for increasing or maximizing productivity and yield.

Embodiments of the inventive concept provide offset printers including: a printing roller; a coating unit configured to apply a printing substance to the printing roller; a patterning unit configured to pattern the printing substance applied to the printing roller from the coating unit; a printing unit configured to transfer the patterned printing substance to a printing medium; and a cleaning unit configured to clean the printing substance remaining on the printing roller by a dry cleaning method.

In some embodiments, the coating unit may include a first drier configured to dry the printing substance applied to the printing roller. The cleaning unit may include: a cleaning plate configured to clean the printing roller; and a cleaning stage configured to support the cleaning plate. The cleaning plate may include a metal or PDMS (polydimethylsiloxane). The cleaning unit may further include a sweeper configured to remove the printing substance from the cleaning plate.

In other embodiments, the cleaning unit may include a cleaning roller configured to clean the printing roller. The cleaning roller may include a blanket roller. The blanket roller may include a metal material, a ceramic material, a Teflon material, or a plastic material. The cleaning unit may further include: a cleaning bath containing a cleaning liquid for cleaning the cleaning roller; and a second drier configured to dry cleaning liquid applied to the cleaning roller. The cleaning unit may further include a cover configured to cover an upper end of the cleaning bath and selectively expose the cleaning roller to the cleaning liquid contained in the cleaning bath.

BRIEF DESCRIPTION OF THE DRAWINGS

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION OF THE EMBODIMENTS

Figure 1:
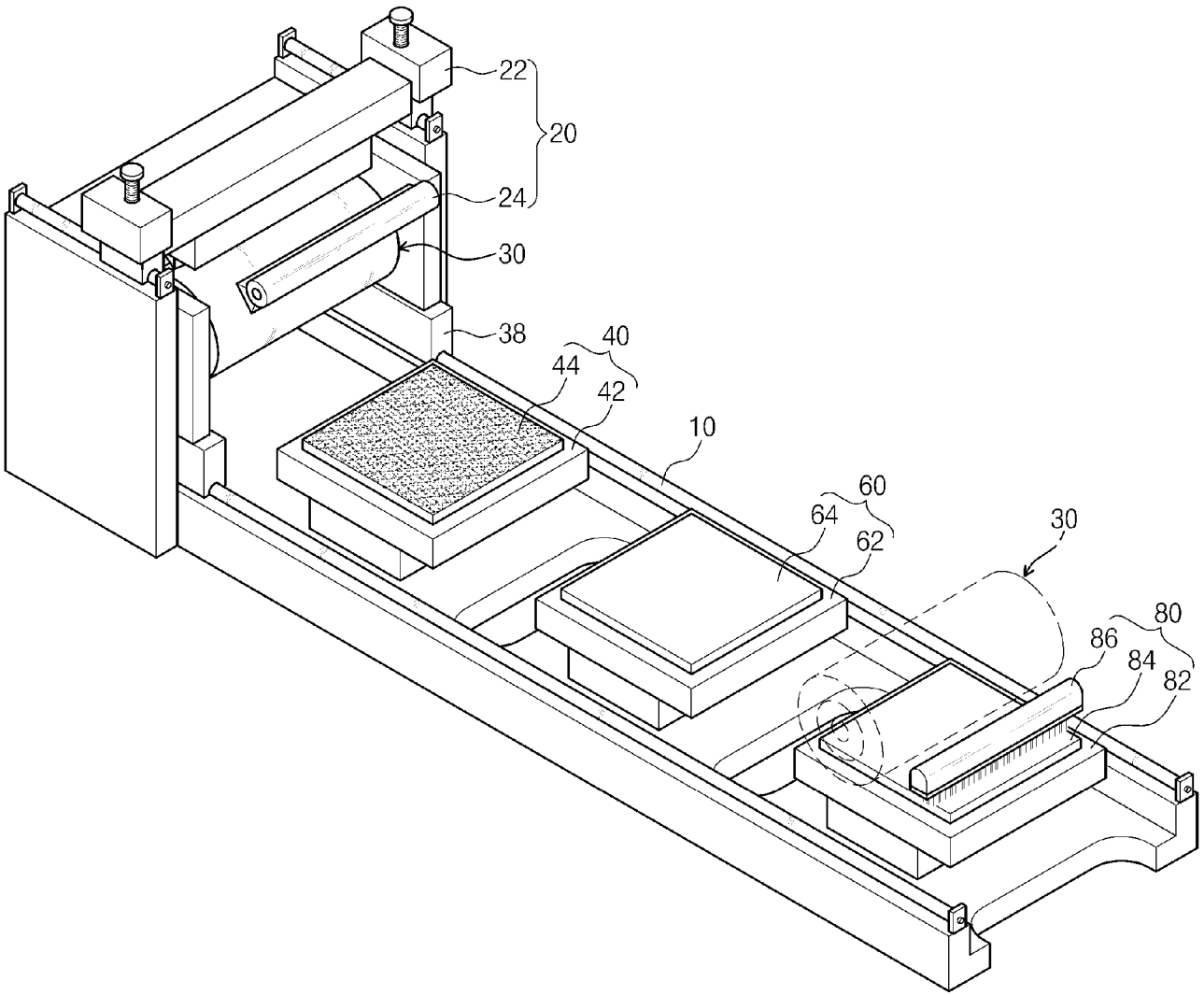
FIG. 1 is a perspective view illustrating an offset printer according to an embodiment of the inventive concept.

Exemplary embodiments of the inventive concept will be described below in more detail with reference to the accompanying drawings. The inventive concept may, however, be embodied in different forms and should not be construed as limited to the embodiments set forth herein. Rather, these embodiments are provided so that this disclosure will be thorough and complete, and will fully convey the scope of the inventive concept to those skilled in the art. Like reference numerals refer to like elements throughout the disclosure.

In the following description, the technical terms are used only for explaining specific embodiments while not limiting the inventive concept. The terms of a singular form may include plural forms unless referred to the contrary. The meaning of "include," "comprise," "including," or "comprising," specifies a property, a region, a fixed number, a step, a process, an element and/or a component but does not exclude other properties, regions, fixed numbers, steps, processes, elements and/or components. Since exemplary embodiments are provided below, the order of the reference numerals given in the description is not limited thereto.

Figure 2:
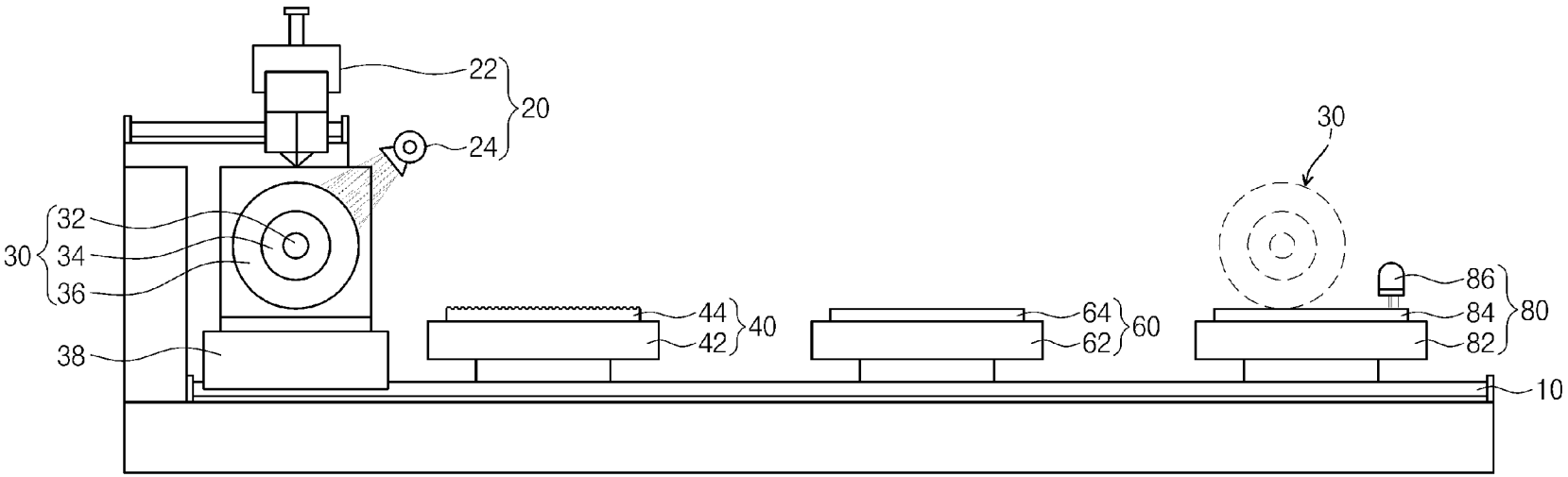
FIG. 2 is a schematic side view illustrating the offset printer of FIG. 1.

FIG. 1 is a perspective view illustrating an offset printer according to an embodiment of the inventive concept, and FIG. 2 is a schematic side view illustrating the offset printer of FIG. 1.

Referring to FIGS. 1 and 2, the offset printer of the current embodiment may include a first drier 24 and a first cleaning unit 80 that are disposed at both ends of linear guides 10, respectively. The first drier 24 may be used to dry liquid ink applied to a printing roller 30 of a coating unit 20. The first drier 24 may generate a wind of heated air toward the printing roller 30. The first drier 24 may prevent swelling of ink on the printing roller 30. The printing roller 30 may apply ink to a cliche 44 and a printing medium 64 for printing. The first cleaning unit 80 may remove ink remaining on the printing roller 30 after printing. The first cleaning unit 80 may clean the printing roller 30 by a dry cleaning method. Owing to the first cleaning unit 80 and the first drier 24, the printing roller 30 may be exposed to a solvent of ink for less time. The first drier 24 and the first cleaning unit 80 may increase the lifespan of the printing roller 30.

Therefore, according to the current embodiment, the offset printer may be increase or maximize productivity and yield.

The linear guides 10 may extend in parallel with the coating unit 20, a patterning unit 40, a printing unit 60, and the first cleaning unit 80. A patterning stage 42, a printing stage 62, and a cleaning stage 82 may be disposed between the linear guides 10. A carrying unit 38 may be disposed on the linear guides 10. The linear guides 10 may support the carrying unit 38 and the printing roller 30.

The carrying unit 38 may move the printing roller 30 along the linear guides 10. The carrying unit 38 may reciprocate the printing roller 30 between the coating unit 20 and the first cleaning unit 80. For example, the carrying unit 38 may include a loader configured to move the printing roller 30 horizontally on the linear guides 10. The loader may rotate the printing roller 30. The loader may include a motor.

The printing roller 30 may include a first shaft 32, a drum 34 disposed around the first shaft 32, and a first blanket roller 36 disposed around the first shaft 32. The first blanket roller 36 may include polydimethylsiloxane (PDMS). PDMS absorbs ink well. PDMS may be vulnerable to a highly volatile solvent.

The coating unit 20 may include an ink coater 22 and the first drier 24. The ink coater 22 may apply ink to the outer surface of the first blanket roller 36 as a printing substance. The ink coater 22 may include a slit die nozzle or a dispenser. The first drier 24 may remove a solvent from ink by blowing hot air. The first drier 24 may dry liquid ink. Therefore, the first drier 24 may prevent swelling of ink. In addition, the first drier 24 may rapidly remove a solvent from ink applied to the first blanket roller 36. The first drier 24 may minimize the time during which the first blanket roller 36 is exposed to a solvent. The first drier 24 may increase the lifespan of the first blanket roller 36. Therefore, according to the current embodiment, the offset printer may increase productivity and yield.

The patterning unit 40 may include the patterning stage 42 and the cliche 44. The cliche 44 may be disposed on the patterning stage 42 to pattern ink applied to the printing roller 30. The cliche 44 may partially remove ink applied to the first blanket roller 36 of the printing roller 30. The cliche 44 may remove regions of ink applied to the first blanket roller 36 of the printing roller 30 so that the remaining regions of the ink can be transferred from the first blanket roller 36 to the printing medium 64. The cliche 44 may be used for reverse printing on the ink applied to the first blanket roller 36. The cliche 44 may includes a raised pattern for partially removing ink from the first blanket roller 36. The raised pattern may be opposite to a pattern to be printed on the printing medium 64.

The printing medium 64 may be placed on the printing stage 62. Patterned ink may be transferred from the first blanket roller 36 to the printing medium 64. Examples of the printing medium 64 may include a glass flat plate, a plastic flat plate, and a wafer. The printing medium 64 may have the same size or area as that of the cliche 44. The printing medium 64 may be replaced with a new one by an external robot arm (not shown).

The first cleaning unit 80 may remove ink remaining on the printing roller 30. The first cleaning unit 80 may clean the first blanket roller 36 of the printing roller 30 by a dry cleaning method. If the first blanket roller 36 of the printing roller 30 is cleaned by a wet cleaning method, the lifespan of the first blanket roller 36 may be reduced. The first cleaning unit 80 may include the cleaning stage 82, a cleaning plate 84 placed on the cleaning stage 82, a sweeper 86 configured to remove contaminants from the cleaning plate 84. The cleaning plate 84 may include a metal such as copper, aluminum, stainless steel, chrome, nickel, and molybdenum. In addition, the cleaning plate 84 may include a polymer such as PDMS, or a natural material such as rubber. The cleaning plate 84 may include the lifespan of the first blanket roller 36. The sweeper 86 may remove contaminants such as ink from the cleaning plate 84.

Therefore, according to the current embodiment, the offset printer may increase or maximize productivity and yield.

Figure 3:
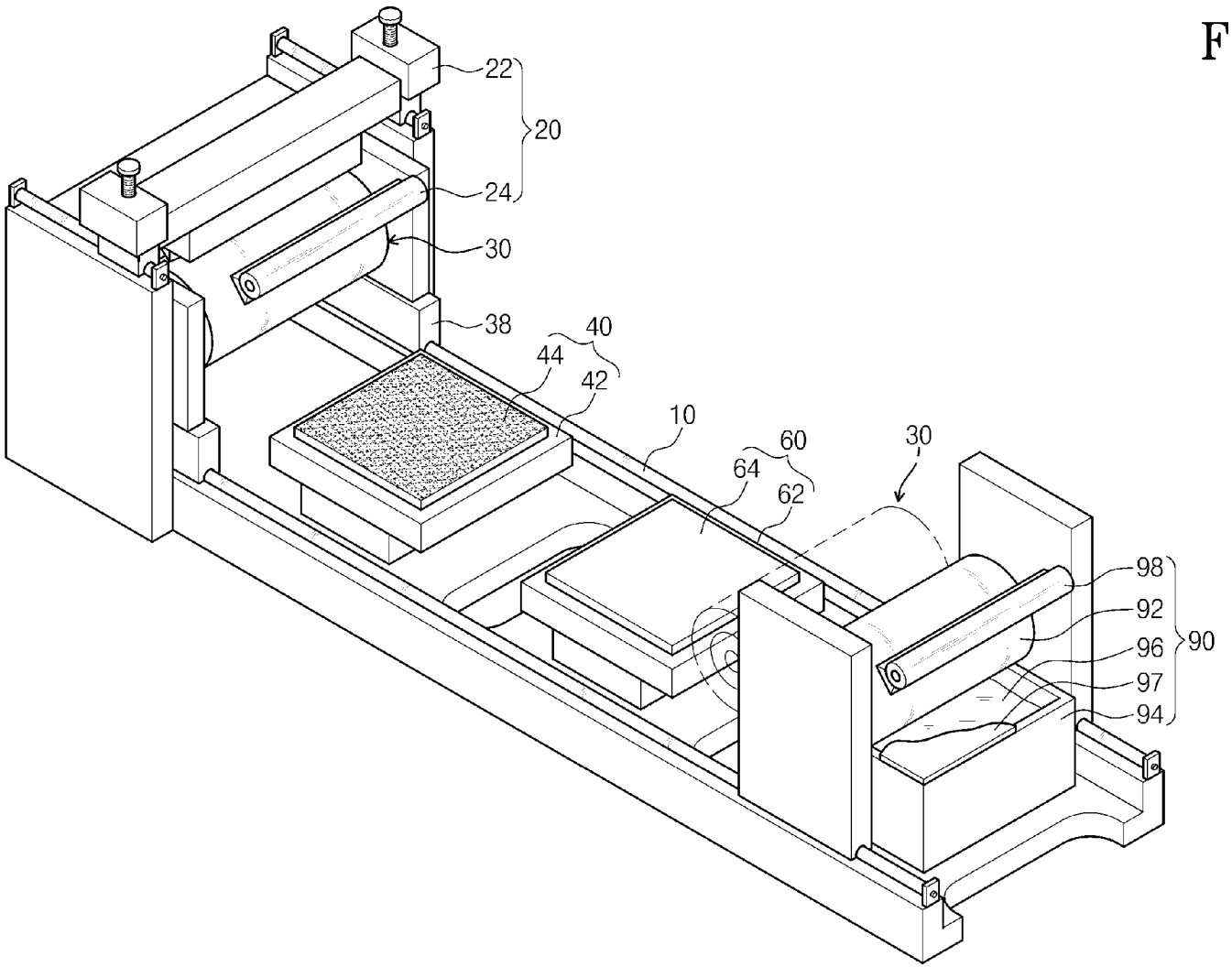
FIG. 3 is a perspective view illustrating an offset printer according to another embodiment of the inventive concept.
Figure 4:
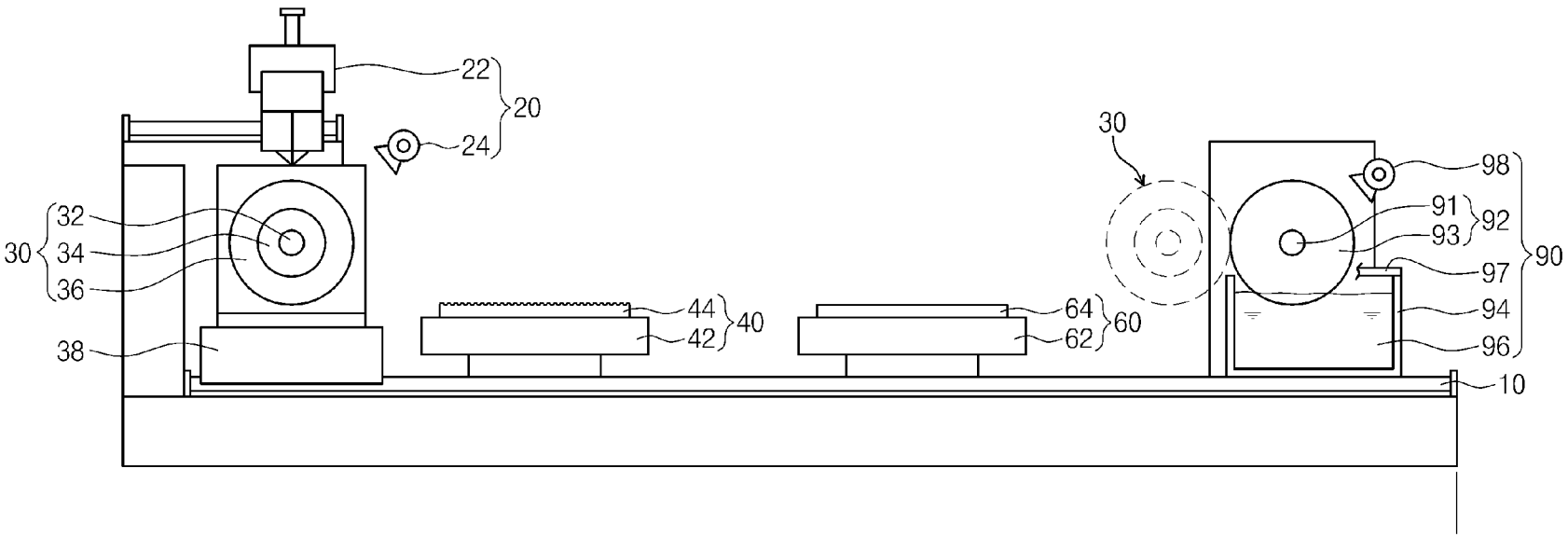
FIG. 4 is a schematic side view illustrating the offset printer of FIG. 3.

FIG. 3 is a perspective view illustrating an offset printer according to another embodiment of the inventive concept, and FIG. 4 is a schematic side view illustrating the offset printer of FIG. 3.

Referring to FIGS. 3 and 4, the offset printer of the current embodiment may include a second cleaning unit 90. The second cleaning unit 90 may include at least one cleaning roller 92 configured to clean ink remaining on a printing roller 30 by a dry cleaning method. The cleaning roller 92 may be reused after being continuously cleaned by a wet cleaning method. The cleaning roller 92 may be cleaned by using a cleaning liquid 96 contained in a cleaning bath 94. The cleaning liquid 96 remaining on the cleaning roller 92 may be removed by blowing a hot air using a second drier 98. The cleaning roller 92 may clean the printing roller 30 by a dry cleaning method. The second cleaning unit 90 may clean the printing roller 30 by a roller-to-roller dry cleaning method. The cleaning roller 92 and a first drier 24 may minimize the time during which the printing roller 30 is exposed to a solvent of ink.

Therefore, according to the current embodiment, the lifespan of the printing roller 30 of the offset printer can be increased, and thus productivity and yield can be increased or maximized.

A coating unit 20 may include an ink coater 22 and the first drier 24. The first drier 24 may be disposed at a position close to the ink coater 22. The first drier 24 may dry ink applied to the printing roller 30 from the ink coater 22. The first drier 24 may blow a hot air to the printing roller 30. The first drier 24 may prevent swelling of ink on the printing roller 30. The first drier 24 may remove a solvent from ink applied to a first blanket roller 36 of the printing roller 30. The first drier 24 may rapidly dry ink applied by the coating unit 20. Therefore, the first drier 24 may increase the lifespan of the first blanket roller 36.

The printing roller 30 may be sequentially moved to the coating unit 20, a patterning unit 40, a printing unit 60, and the second cleaning unit 90 by a carrying unit 38. The carrying unit 38 may move the printing roller 30 along a plurality of linear guides 10. The linear guides 10 may extend in parallel with each other along both sides of a patterning stage 42, a printing stage 62, and the cleaning bath 94.

The second cleaning unit 90 may include the cleaning roller 92 to clean the printing roller 30. The cleaning roller 92 and the printing roller 30 may be brought into contact with each other. The cleaning roller 92 may include a second shaft 91 and a second blanket roller 93. The second blanket roller 93 may clean ink remaining on the first blanket roller 36 by a dry cleaning method. The second blanket roller 93 may be brought into contact with the first blanket roller 36. The second blanket roller 93 may be formed of a material that is chemically stable against surfactants or volatile substances such as a solvent. The second blanket roller 93 may include materials such as a metal material, a ceramic material, a Teflon material, and a plastic material. The second blanket roller 93 may be dipped in the cleaning liquid 96 of the cleaning bath 94. The second blanket roller 93 may be cleaned by using the cleaning liquid 96 of the cleaning bath 94.

The cleaning liquid 96 may remove contaminants such as ink from the second blanket roller 93. The cleaning liquid 96 may include a surfactant or solvent. Ink may dissolve in the surfactant or solvent. The cleaning liquid 96 may be filled in the cleaning bath 94 to a predetermined level or higher.

The cleaning liquid 96 remaining on the second blanket roller 93 may be removed by the second drier 98 disposed outside the cleaning bath 94. The second drier 98 may be disposed at a side of the cleaning roller 92 opposite to the printing roller 30. The second drier 98 may remove the cleaning liquid 96 from the surface of the second blanket roller 93 by blowing a hot air. The second blanket roller 93 may clean the first blanket roller 36 by a dry cleaning method. The second blanket roller 93 may increase the lifespan of the first blanket roller 36. Therefore, according to the current embodiment, the offset printer can increase or maximize productivity and yield.

A cover 97 may be disposed at an upper end of the cleaning bath 94. The cover 97 may block a hot air blown from the second drier 98 so that the hot air cannot enter the cleaning bath 94. The cover 97 may partially cover the cleaning bath 94. The cleaning roller 92 may be selectively exposed to the cleaning liquid 96 of the cleaning bath 94 by the cover 97.

Therefore, according to the current embodiment, the offset printer can increase or maximize productivity and yield.

As described above, according to the inventive concept, the drier may be used to dry ink applied to the printing roller by the coating unit, and after printing, the cleaning unit may remove ink remaining on the printing roller by a dry cleaning method. The drier and the cleaning unit minimize the time during which the printing roller is exposed to a solvent of ink. Therefore, the lifespan of the printing roller can be increased. Therefore, according to the offset printer of the embodiments, productivity and yield can be increased or maximized.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. An offset printer comprising:

a printing roller;

a coating unit configured to apply a printing substance to the printing roller;

a patterning unit configured to pattern the printing substance applied to the printing roller from the coating unit;

a printing unit that transfers the patterned printing substance to a printing medium; and a cleaning unit configured to clean the printing substance remaining on the printing roller by a dry cleaning method;

wherein the coating unit includes a first drier configured to dry the printing substance applied to the printing roller; and wherein the cleaning unit includes a cleaning plate configured to clean the printing roller.

2. The offset printer of claim 1, wherein the cleaning unit further comprises a cleaning stage configured to support the cleaning plate.

3. The offset printer of claim 2, wherein the cleaning plate includes a metal or PDMS (polydimethylsiloxane).

4. The offset printer of claim 2, wherein the cleaning unit further comprises a sweeper configured to remove the printing substance from the cleaning plate.

5. The offset printer of claim 1, wherein the cleaning unit comprises a cleaning roller configured to clean the printing roller.

6. The offset printer of claim 5, wherein the cleaning roller comprises a blanket roller.

7. The offset printer of claim 6, wherein the blanket roller comprises a metal material, a ceramic material, a Teflon material, or a plastic material.

8. The offset printer of claim 5, wherein the cleaning unit further comprises:

a cleaning bath containing a cleaning liquid for cleaning the cleaning roller; and a second drier configured to dry clean liquid applied to the cleaning roller.

9. The offset printer of claim 8, wherein the cleaning unit further comprises a cover configured to cover an upper end of the cleaning bath and selectively expose the cleaning roller to the cleaning liquid contained in the cleaning bath.

* * * * *